United States Patent [19]

Diggs

[11] 3,999,288

[45] Dec. 28, 1976

[54] METHOD OF MAKING A LIGHTWEIGHT ELECTRICAL CABLE

[76] Inventor: Richard E. Diggs, 12 A Road, Carthage, Mo. 64836

[22] Filed: Mar. 5, 1976

[21] Appl. No.: 664,106

Related U.S. Application Data

[62] Division of Ser. No. 557,679, March 12, 1975, Pat. No. 3,961,832.

[52] U.S. Cl. ..... 29/624; 29/628

[51] Int. Cl.[2] ..... H01B 13/00

[58] Field of Search ..... 29/624, 625, 628, 629, 29/630 R; 174/75, 128, 129; 339/19, 28, 29 R, 29 B, 222, 229, 240, 242, 277 R, 278 R, 278 A; 140/71 R

[56] References Cited

UNITED STATES PATENTS

| | | | |
|---|---|---|---|
| 508,643 | 11/1893 | Southworth | 339/278 A |
| 2,322,388 | 6/1943 | Powledge | 339/228 X |
| 2,462,993 | 3/1949 | Peters et al. | 339/277 R X |

FOREIGN PATENTS OR APPLICATIONS

| | | | |
|---|---|---|---|
| 16,100 | 12/1886 | United Kingdom | 140/71 R |

*Primary Examiner*—James R. Duzan
*Attorney, Agent, or Firm*—Shoemaker and Mattare, Ltd.

[57] ABSTRACT

A lightweight electrical cable comprises a plurality of laminations of loops of continuous strips of silver foil, defining an opening at least at one end thereof for receiving a battery post or other electrical connector, and a spring clip engagable with the cable end received on an electrical connector to readily releasably secure the cable in place. The method of making an electrical cable as described above is also disclosed.

3 Claims, 8 Drawing Figures

METHOD OF MAKING A LIGHTWEIGHT ELECTRICAL CABLE

CROSS REFERENCE TO RELATED APPLICATIONS

The present case is a division of Ser. No. 557,679, filed Mar. 12, 1975, now U.S. Pat. No. 3,961,832, issued on June 8, 1976.

BACKGROUND OF THE INVENTION

This invention relates to electrically conductive cables, and in particular, to an electrically conductive cable which is lightweight and yet is strong and which is capable of conducting a maximum amount of electrical current.

There are many applications in which such lightweight yet strong and efficient electrical cables are desirable or necessary. For example, in the aerospace industry, the use of electrical power sources and conducting cables in satellites and space capsules is common, and it is essential in such applications that the electrically conductive cables be lightweight, and yet that they be efficient and strong and have means for effecting secure connection of the cables to electrical terminals or connectors. Moreover, lightweight, yet strong and efficient electrical cables are necessary and/or desirable in the computer industry and in many other applications. Further, it is desirable that the electrical cable be economical and simple to manufacture.

Objects of the Invention

Accordingly, it is an object of this invention to provide a lightweight, yet strong and efficient electrical cable which is both simple in construction and economical to manufacture.

Another object of the invention is to provide a lightweight, yet strong and efficient electrical cable wherein the cable is made of a plurality of laminated loops of silver foil, and the loops are separated to define an opening at least at one end of the cable for receiving an electrical connector.

A further object of the invention is to provide a lightweight, yet strong and efficient electrical cable comprising a plurality of laminated loops of a continuous strip of silver foil.

A still further object is to provide in combination a lightweight, yet strong and efficient electrical cable having a loop or opening at least at one end thereof received on a substantially circular electrical connector, and wherein a resiliently yieldable spring clip means is engaged on the end of the cable, clamping it to the connector.

A still further object of this invention is to provide a method of making the electrical connector as described herein.

DETAILED DESCRIPTION OF THE INVENTION

Figure 1:
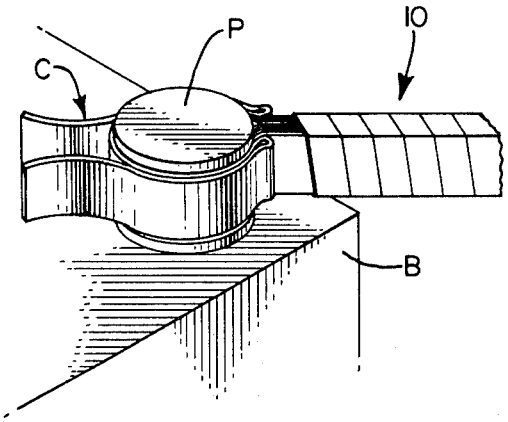
FIG. 1 is a fragmentary, top perspective view of a portion of the cable in accordance with the invention shown attached to a battery post of a battery.
Figure 2:
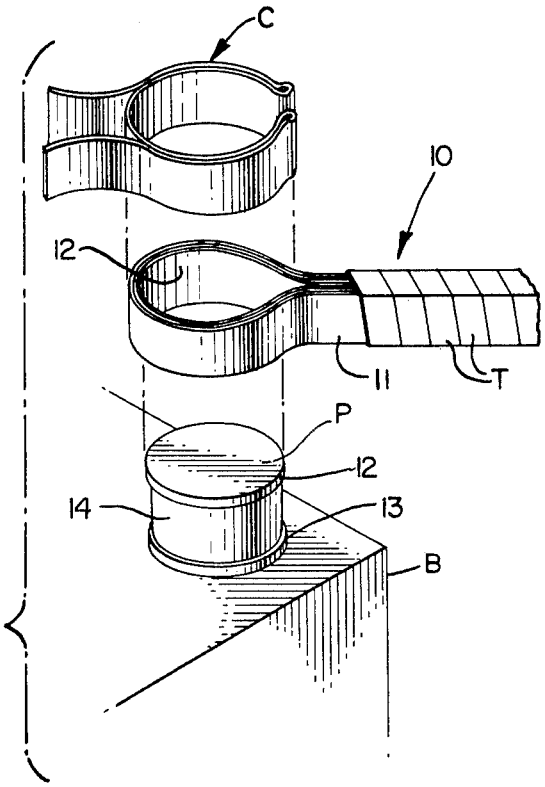
FIG. 2 is an exploded, perspective view of the cable, spring clip and battery and battery post of FIG. 1
Figure 3:
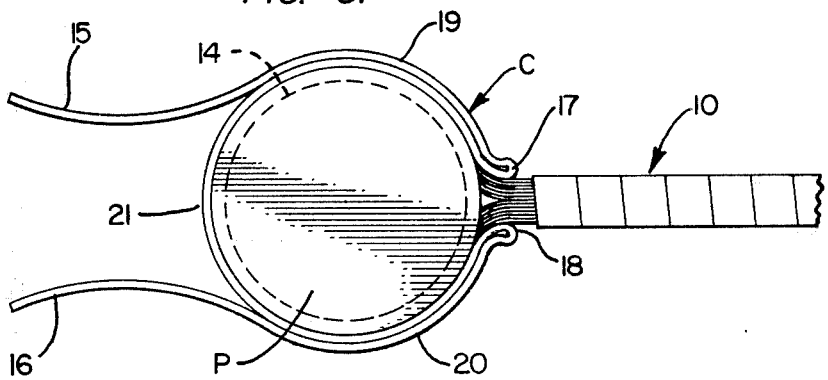
FIG. 3 is an enlarged plan view of the cable, spring clip and electrical connector according to the invention.
Figure 4:
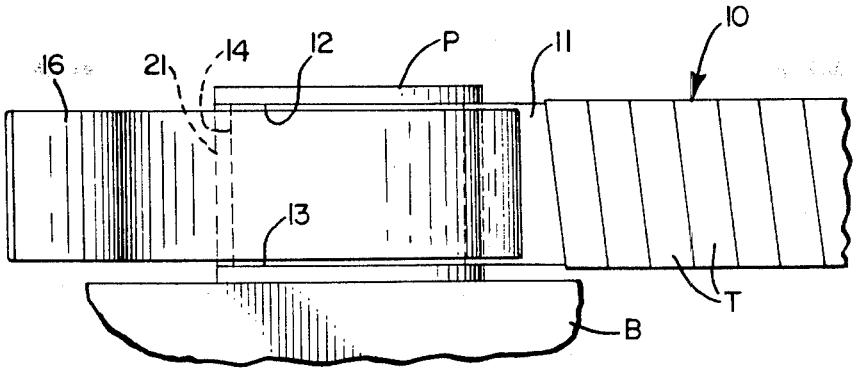
FIG. 4 is a side view in elevation of the structure shown in FIG. 3.

In the drawings, wherein like reference numerals indicate like parts throughout the several views, a cable 10 is connected to the post P of a battery B by means of a spring clip C. The cable 10 comprises a plurality of laminated loops 11 of a continuous strip of silver foil, and wherein the loops are pressed together between the ends thereof, and at opposite ends of the cable the loops are spaced apart to define an electrical connector receiving opening 12 therebetween. If desired, the cable may be helically wrapped with tape T or other suitable material between the ends thereof to maintain the laminated loops in tightly compressed engagement with one another.

The electrical connector or post P, as, for example, on the battery B, comprises an upstanding post having a substantially circular cross section, and with a pair of spaced shoulders 12 and 13 at the upper and lower ends thereof, respectively, defining an annular recess 14 therebetween over which the open or looped end of cable 10 is received. The vertical extent of the recess 14 is substantially the same as the width of the cable 10, whereby when the post P is received through the opening 12, the laminated silver foil snugly engages the material of the post between the shoulders, and the upper and lower edges of the cable engage against the shoulders 12 and 13 to prevent arcing between the post and cable. In order to securely, yet releasably connect the cable to the post, the spring clip C is preferably made of spring steel, although it could be made of other materials having a natural resiliency, and the clip C comprises an elongate strip of spring steel, having the opposite end portions thereof formed to define finger gripping portions 15 and 16 disposed in spaced apart, substantially parallel relationship to one another. The strip of spring steel or other suitable material is bent reversely upon itself between the ends thereof to define opposed, confronting ends 17 and 18 of spaced apart, arcuate jaws 19 and 20, and the ends 17 and 18 of the jaws are joined by a substantially circularly shaped loop 21 of the material, which engages the post P within the recess 14.

With this construction, the finger engaging portions 15 and 16 are grasped and pressed toward one another, with the result that the ends 17 and 18 of the jaws move relatively apart, thus enabling the spring clip C to be placed over the looped portion of the cable which is received on the post P, and the finger engaging portions are then released, whereby the jaws of the spring clip tightly engage the cable, pressing it against the post substantially completely around the circumference of the post, and accordingly, effecting a secure electrical connection between the post and cable.

Figure 5:
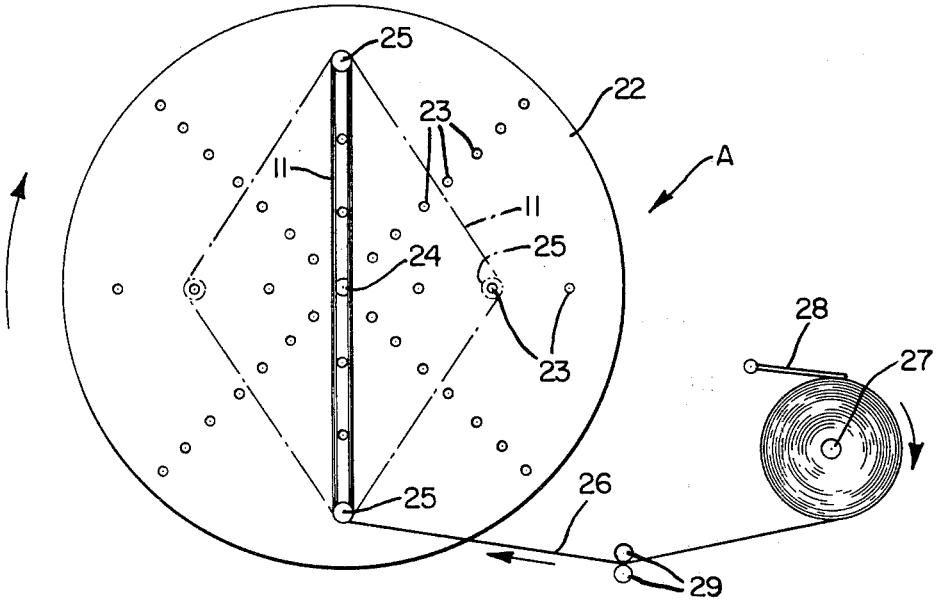
FIG. 5 is a schematic view in elevation of the apparatus used to make a cable in accordance with the present invention.
Figure 6:
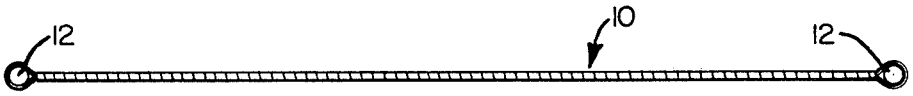
FIGS. 6 and 7 are side and plan views, respectively, of a completed electrical cable in accordance with the invention.
Figure 7:
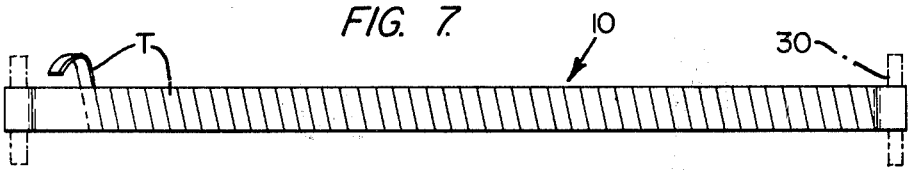
Figure 8:
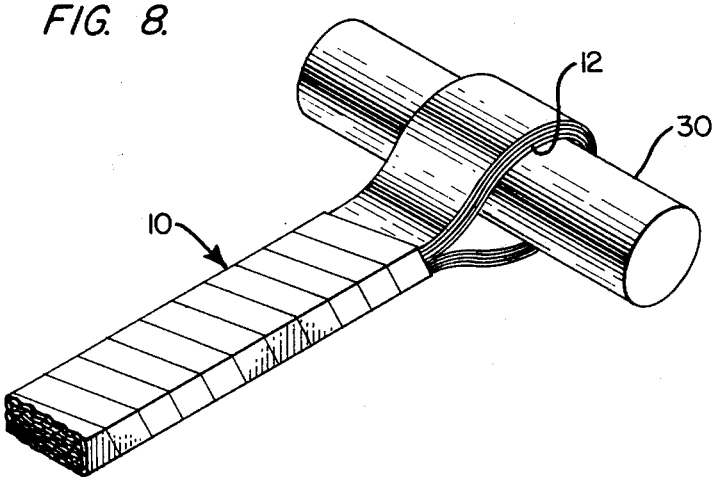
FIG. 8 is an enlarged, fragmentary, perspective view of a portion of the cable in accordance with the invention, with a plug inserted through the loop at the end thereof to retain the shape of the loop prior to use of the cable.

In FIG. 5, a portion of an apparatus for making the cable according to the invention is indicated generally at A, and comprises a substantially circular assembly wheel 22 having a plurality of apertures or openings 23 formed therein in spaced apart relationship around a central axis of rotation 24. A plurality of pegs 25 are placed in a selected number of the apertures 23 in a predetermined spaced relationship, and a strip 26 of silver foil is engaged with the pegs 25, and the wheel 22 is then caused to rotate, whereby the pegs rotate as a unit about the axis of rotation 24, and the strip 26 of silver foil is wound on the spaced apart pegs 25, thus forming a plurality of laminated loops 11 of silver foil. The strip 26 of silver foil may be fed from a suitable spool 27 or the like if desired, having an anticoast brake 28 associated therewith to prevent freewheeling or overrunning of the spool 27, and a tension brake means 29 is operatively engaged with the strip of foil to insure that the foil is wound tightly upon the pegs 25. If desired, the laminated loops of silver foil may then be helically wrapped between the opposite ends thereof with a strip of tape T or other suitable material, as desired, and in order to retain the shape of the looped end of the cable, plugs 30 may be inserted therein.

Although the cable has been described herein as comprising a continuous strip of silver foil to provide maximum power transfer, it could be made of other suitable materials, if desired. Additionally, the spring clip provides maximum security to the cable connection with the electrical connector, with a minimum amount of weight, and it also provides a cable to lug or connector attachment, which is much more simple and quick to effect than prior art devices. Additionally, the cable and spring clip of the invention can be installed and removed with the fingers, and does not require the use of any tools.

In addition to the applications described herein, it should be apparent that there are many other applications for the invention, using different materials for special applications, such as, for example, with standard automobile batteries and the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A method of forming a lightweight electrical cable comprising the steps of:
   - supporting a plurality of pegs in predetermined spaced apart relationship around an axis of rotation;
   - providing a continuous flat strip of silver foil, said flat strip having edges and a substantially constant width dimension throughout the length thereof;
   - orienting said flat strip of foil so that said pegs extend transversely of said strip;
   - engaging an end of said strip of foil with at least one of said pegs;
   - rotating said pegs as a unit around said axis of rotation;
   - maintaining said strip of foil in a location adjacent said pegs so that said foil is wound around said pegs into a plurality of layers having the side edges thereof substantially coterminously positioned to form a liminated loop of foil having a width dimension essentially equal to the width of said flat strip;
   - removing said laminated loop from said pegs;
   - pressing said loop together to form an elongated structure with an innermost layer of said laminated loop having a pair of confronting faces which contact each other for a predetermined length of said elongated structure and which faces are spaced apart in non-contacting relationship with each other adjacent the opposite ends of said elongated structure to form loops thereat; and
   - wrapping the elongated structure between the ends thereof to tightly press the loop together.

2. The method as defined in claim 1, wherein the step of wrapping the elongated structure includes helically wrapping said structure to tightly press said loop together to form a cable.

3. The method as defined in claim 2, including the steps of inserting plugs in the openings at opposite ends of the cable to maintain the shape of the openings prior to use of the cable and removing said plugs when said cable is to be used.

* * * * *